US006136114A

United States Patent [19]

Johnson et al.

[11] Patent Number: 6,136,114

[45] Date of Patent: Oct. 24, 2000

[54] GAS GENERANT COMPOSITIONS METHODS OF PRODUCTION OF THE SAME AND DEVICES MADE THEREFROM

[75] Inventors: Steven Johnson; Larry H. Barr; Brian E. Smith, all of Hollister, Calif.

[73] Assignee: Teledyne Industries, Inc., Los Angeles, Calif.

[21] Appl. No.: 08/941,167

[22] Filed: Sep. 30, 1997

[51] Int. Cl.[7] ..... C06B 43/00

[52] U.S. Cl. ..... 149/22

[58] Field of Search ..... 149/22; 423/294, 423/276

[56] References Cited

U.S. PATENT DOCUMENTS

| | | | |
|---|---|---|---|
| 3,298,799 | 1/1967 | Hough et al. | 149/22 X |
| 4,089,716 | 5/1978 | Goddard et al. | 149/22 X |
| 4,094,712 | 6/1978 | Goddard et al. | 149/22 X |
| 4,130,585 | 12/1978 | Goddard | 149/22 |
| 4,135,956 | 1/1979 | Goddard et al. | 149/22 |
| 4,138,282 | 2/1979 | Goddard et al. | 149/22 X |
| 4,139,404 | 2/1979 | Goddard et al. | 149/22 X |
| 4,202,712 | 5/1980 | Goddard | 149/22 |
| 4,315,786 | 2/1982 | English et al. | 149/22 |
| 4,468,263 | 8/1984 | Artz et al. | 149/22 |
| 5,387,296 | 2/1995 | Taylor et al. | 149/35 |
| 5,401,340 | 3/1995 | Doll et al. | 149/22 |

FOREIGN PATENT DOCUMENTS

| | | |
|---|---|---|
| 661 252 | 5/1995 | European Pat. Off. . |
| 661 253 | 5/1995 | European Pat. Off. . |
| 659 715 | 6/1995 | European Pat. Off. . |
| WO 95/18780 | 7/1995 | WIPO . |

*Primary Examiner*—Charles T. Jordan
*Assistant Examiner*—Aileen J. Baker
*Attorney, Agent, or Firm*—Gibson, Dunn & Crutcher LLP

[57] ABSTRACT

Gas generant compositions are disclosed that generally include an a fuel source including a compound having a fuel portion and a fuel oxidizing portion, a fuel oxidizer, and a borohydride catalyst of the oxidation of said fuel portion by said fuel oxidizing portion and said fuel oxidizer to produce gaseous reaction products. In preferred compositions the fuel source is comprised of the elements nitrogen, carbon, hydrogen and water and combusted to produce $N_2$, $CO_2$ and $H_2O$ as the primary reaction products. Preferably, the fuel oxidizer is a metal nitrate, and particularly potassium nitrate, because the potassium will generally be included in solid products and not in the form of a potentially harmful gas. It is also preferred that the combustion reaction be catalyzed using borohydrides. Potassium borohydrides, such as $K_2B_{12}H_{12}$ and $K_2B_{10}H_{10}$, are particularly preferred. In addition, binding materials, and dry lubricants or processing aids are included, when compositions are used in pellet or tablet form. The compositions detailed in this invention react at relatively high rates and they produce large quantities of gas within fractions of seconds. In addition, these compositions produce only small amounts of slag which are readily filterable. The gases produced are then available to perform a work function in automotive safety restraint systems such as seat belt pretensioners and automobile air bag inflators, as well as in other inflatable device applications, such as lifesaving buoying devices, life rafts and aircraft slides.

19 Claims, 1 Drawing Sheet

GAS GENERANT COMPOSITIONS METHODS OF PRODUCTION OF THE SAME AND DEVICES MADE THEREFROM

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

The present invention is directed generally to gas generating compositions, methods of production of the same and devices made therefrom and, more particularly, gas generating compositions having varying burn rates catalyzed using borohydride salts for use in seat belt pretensioners and other applications requiring rapid gas generation.

Gas generating compositions have been used for many years in various pyrotechnic applications. In recent years, gas generating compositions have been found to be useful in safety applications, such as in vehicle passive restraint airbag systems and seat belt pretensioners.

The new application of gas generating technology to consumer products have raised new issues relating to the exposure of consumers to the technology. For example, in the context of automobile safety restraint systems, gas generating compositions must satisfy several important design criteria. The design criteria require that gas generated by reacting the compositions be generated almost instantaneously and at relatively low temperatures to minimize the potential for burning the automobile occupants. The safety restraint specifications also put strict limits on the generation of toxic or harmful gases and solid particulates.

Currently, the most commonly employed gas generant in automotive safety restraint systems is sodium azide ($NaN_3$), which by itself is a relatively toxic material. The oral rat $LD_{50}$ of $NaN_3$ has been reported as 27 mg/kg.

The combustion products of the sodium azide gas generant are also considered to be relatively toxic. In most of the safety restraint systems using sodium azide as the gas generant, molybdenum disulfide or sulfur has been utilized as oxidizers for the sodium azide. The gas generant reaction products include hydrogen sulfide, sodium hydroxide, and sodium sulfide which are all fairly caustic.

A number of efforts have been initiated to develop replacements for the azide fuel gas generant compositions in vehicle restraint systems. The development are generally focused on replacing the azide fuel, and particularly $NaN_3$, with fuel and oxidizer compositions that produce more benign oxidation products, specifically $N_2$, $H_2O$, and $CO_2$. However, the various non-azide compositions have not been extensively used to date as replacements for azide composition systems.

The azide free fuel compositions generally employ a blend of two or more discrete fuel sources, such as tetrazoles and triazoles, dicyanamide salts, and other nitrogen containing compounds in an attempt to provide performance comparable to azide fuels. The discrete fuel sources are mixed with one or more oxidizers, such as transition metal oxides, nitrates, chlorates and perchlorates, in varying quantities to produce a desired gas generation rate. The compositions also may include catalysts and binders for additional control over the burn rate and for processing, respectively.

In both the azide and non-azide systems, the performance predictability of the compositions depends upon the homogeneous distribution of the discrete fuel source and the discrete oxidizer within the compositions. Therefore, it is important that the composition ingredients be mixed to a sufficient extent to ensure the homogeneity of the mixture. However, in practice, it is improbable that homogeneous mixtures will actually be achieved, especially as batch size of the composition increases.

Recognizing the practical inhomogeneity of the compositions, one method of ensuring the proximity of the fuel sources to the oxidizers is to provide an excess amount of the oxidizer. For example, oxidizers are often include 200% of the stoichiometric quantity needed to completely oxidize the fuel, and the resulting percentage of the fuel in the composition often ranges from 10–20%. The excess oxidizer increases the amount of the composition necessary for a specific application and the overall cost of the composition.

Thus, there are continuing needs for gas generating compositions and safety devices produced therefrom that are less costly, more predictable in performance, and more compatible with consumer related applications, such as airbags and seat belt pretensioners.

BRIEF SUMMARY OF THE INVENTION

The aforementioned needs are addressed by compositions, methods, and devices in accordance with the present invention. The compositions generally include a fuel source including a compound having a fuel portion and a fuel oxidizing portion, a fuel oxidizer, and a borohydride catalyst of the oxidation of said fuel portion by said fuel oxidizing portion and said fuel oxidizer to produce gaseous reaction products.

In preferred compositions the fuel source is comprised of the elements nitrogen, carbon, hydrogen and oxygen and combusted to produce $N_2$, $CO_2$ and $H_2O$ as the primary reaction products. Preferably, the fuel oxidizer is a metal nitrate, and particularly potassium nitrate, because the potassium will generally be incorporated in solid reaction products and not in the form of a potentially harmful gas. It is also preferred that the combustion reaction be catalyzed using borohydrides. Potassium borohydride salts, such as $K_2B_{12}H_{12}$ and $K_2B_{10}H_2O$, are particularly preferred. In addition, binding materials, and dry lubricants or processing aids are included, when compositions are used in pellet or tablet form.

The compositions detailed in this invention react at relatively high rates and they produce large quantities of gas within fractions of seconds. In addition, these compositions produce only small amounts of slag which are readily filterable. The gases produced are then available to perform a work function in automotive safety restraint systems such as seat belt pretensioners and automobile air bag inflators, as well as in other inflatable device applications, such as lifesaving buoying devices, life rafts and aircraft slides.

The present invention offers a substantial alternative to the current azide based generants that are currently the most prevalent gas generant based automotive safety restraints. Accordingly, the present invention addresses the aforementioned needs of the industry to provide compositions, and devices that are less costly, more predictable in performance, and more compatible with consumer related applications. These advantages and others will become apparent from the following detailed description.

BRIEF DESCRIPTION OF THE DRAWINGS

Preferred embodiments of the invention will now be described, by way of example only, with reference to the accompanying drawing wherein like members bear like reference numerals and wherein.

DETAILED DESCRIPTION OF THE INVENTION

Figure 1:
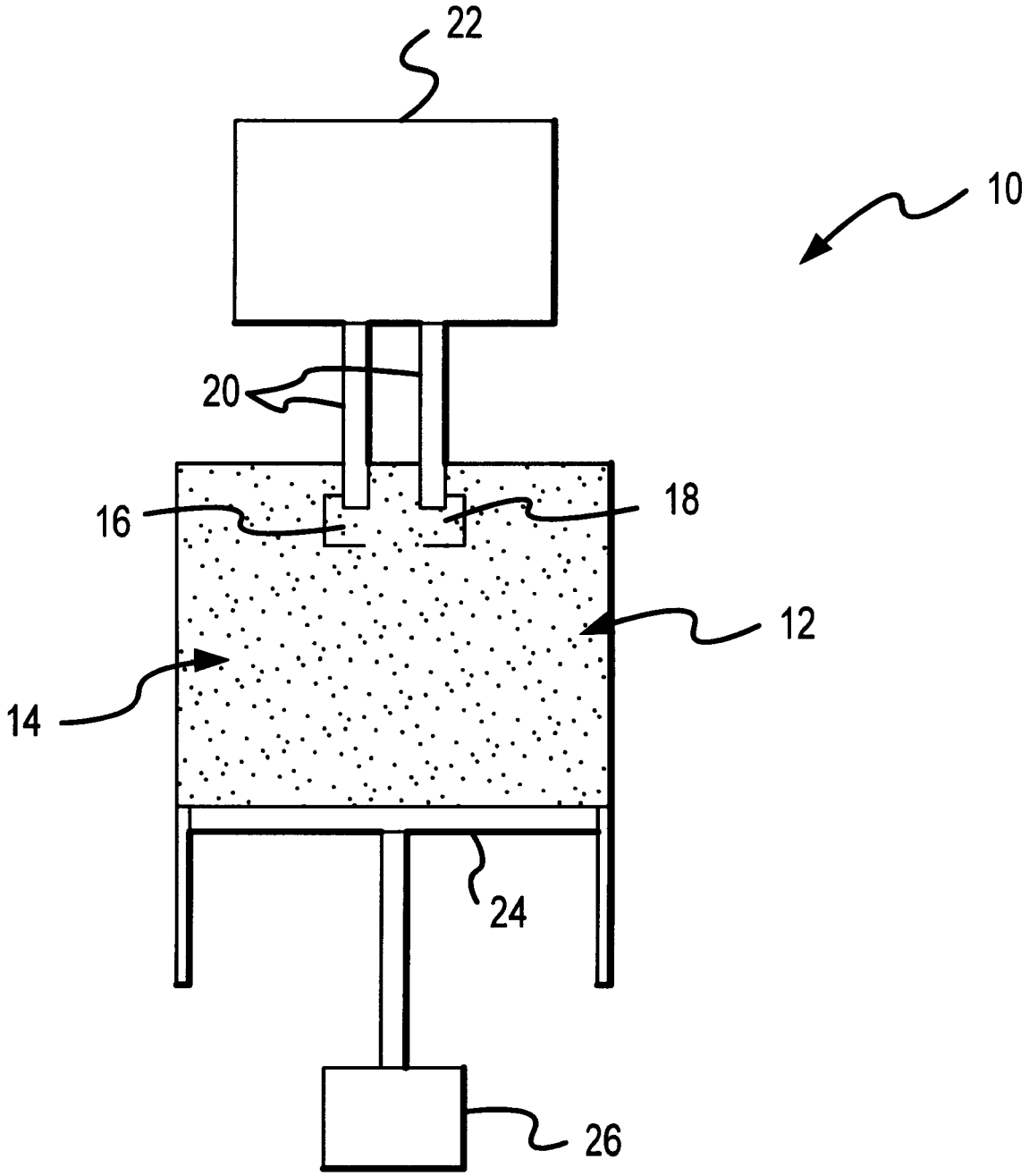
FIG. 1 shows a seat belt pretensioner device of the present invention.

Compositions, methods and devices 10 of the present invention will be described generally with reference to the drawing for the purpose of illustrating the present preferred embodiments of the invention only and not for purposes of limiting the same.

The gas generant compositions of the present invention generally include a fuel source in the form of a compound having a fuel portion and fuel oxidizing portion, and a fuel oxidizer. The fuel source and the fuel oxidizer are generally in a powder form and may include additives, such as burn rate modifiers. In practice, binder material and processing aids and dry lubricants are typically added to allow the composition to be formed into pellets.

The fuel portion and the fuel oxidizing portion can be incorporated in the fuel source in a cation/anion relationship or a functional group on a base compound. In this manner, the fuel portion will always be proximate to an oxidizing agent during the initiation of the combustion reaction. Therefore, the inability to achieve complete homogeneity of the mixture in a practical situation tends not to result in the performance variations comparable to compositions that employ discrete fuel sources and oxidizers. The incorporation of the fuel and oxidizing portions in the same compound also facilitates a reduction in the excess oxidizer that must be added to the composition to help ensure complete oxidation of the fuel and a commensurate reduction in the cost of the composition.

In a preferred embodiment of the composition, the fuel portion composition is preferably composed of the elements nitrogen, carbon, and hydrogen. The gaseous products produced by the combustion of the fuel portion can thus be limited to diatomic nitrogen, carbon dioxide and water. Similarly, the fuel oxidizing portion is preferably limited to compositions containing nitrogen, carbon, hydrogen, and oxygen.

In a preferred embodiment, the fuel source includes guanidine, its derivatives and combinations thereof as the fuel portion along with nitrate as the fuel oxidizing portion. Examples of these compounds include guanidine nitrate, ($(H_2N)_2C{=}NHHNO_3$), triaminoguanidine nitrate ($H_2NNC(NHNH_2)_2HNO_3$), and nitroguanidine ($O_2NNHC({=}NH)NH_2$). An additional benefit of using guanidine nitrate is that it is readily available.

The fuel portion can include triazoles and tetrazoles, such as guanylaminotetrazole nitrate. One skilled in the art will appreciate that other commonly used oxidizers, such as chlorates and perchlorates, can be used as the oxidizing portion of the fuel source; however, these oxidizers are less preferred because the gaseous reaction products will most likely contain chlorine compounds.

In low temperature applications, it may be desirable to eliminate hydrogen from the fuel source composition, because of the possibility of that water vapor produced during the combustion reaction could condense and affect the performance of the gas generant. Therefore, it may be desirable to employ a fuel portion composition containing only nitrogen and carbon, such as the metallic salts of bitetrazoles and azotetrazoles.

The fuel source may also include minor portions of additional fuel compounds that do not contain oxidizing portions. The extent of the additional fuel compounds included in the fuel source should be limited to quantities that provide enhanced properties, such as higher gas generation rate or lower ignition or flame temperature, without substantially detracting from the aforementioned benefits of coupling the fuel portion and the oxidizing portion.

The fuel oxidizer is preferably an inorganic nitrate. Metal nitrates, especially alkali and alkaline nitrates, are well suited for use in the composition. Potassium nitrate is particularly well suited for use in conjunction with a catalyst because the potassium will often be incorporated in a solid reaction product during combustion and is also readily available. Strontium is also useful as a cation with nitrate and sodium to a lesser extent because of the potential to form sodium oxide during combustion. Ammonium nitrate can also be used as the fuel oxidizer; however, the thermal stability of mixtures containing ammonium nitrate are generally lower than those containing potassium nitrate.

One skilled in the art will further appreciate that it is not necessary to have the same oxidizing agent as the fuel oxidizer and oxidizing portion of the fuel source. The particular oxidizing agents employed in the present invention can be varied to suit the application for the gas generant composition. Accordingly, the fuel oxidizer can also be transition metal oxides, as well as chlorates and perchlorates or other oxidizers.

The Applicants have found that the combustion rate of fuel source and fuel oxidizer composition of the present invention can be controlled through the use of a burn rate modifier, or catalyst, by merely varying the ratio of the fuel source to the catalyst. In particular, the Applicants have found borohydrides (i.e., $BH_4^-$, $B_3H_8^-$, $B_8H_8^{-2}$, $B_9H_{15}$, $B_{10}H_{14}$, $B_{10}H_{10}^{-2}$, $B_{11}H_{14}^-$, $B_{12}H_{12}^{-2}$, etc.) to provide effective control of the combustion rate, or burn rate. Of the borohydride family, $B_{12}H_{12}^{-2}$ and $B_{10}H_{10}^{-2}$ salts, and particularly potassium salts, have been found to provide effective control of the burn rate. As with the choice of the oxidizing agents, it is not necessary for the cation associated with the catalyst and the fuel oxidizer to be the same.

Because of the proximity of the fuel portion and the oxidizing portion, and the amount of excess oxidizer can be reduced, higher percentage of the fuel source can be used in the present invention, if desired. Preferably, the fuel source accounts for 10–50% by weight of the composition, the oxidizer accounts for 45–90% by weight of said composition, and the borohydride catalyst ranges from 0–5% by weight of the composition.

Gas generant compositions are typically prepared in powder form and made into pellets before use. Additional ingredients include binding material, such as tetranitrocarbazole, and/or processing aids or dry lubricants, such as magnesium or calcium stearate, may be included in the composition to aid in the production of the pellets or tablets. The binder materials and processing aids can further account for additional 0–5% and 0.1–1.0% of the composition, respectively.

EXAMPLES

The compositions and methods of the present invention will be further described in the following non-limiting examples. The fuel source, the fuel oxidizer, the binding materials, and the dry lubricants are incorporated into the compositions as finely divided solid powder ingredients in the percentages listed below. The average particle sizes range from 1 to 500 microns. Best results have been achieved when the average particle sizes range from 5 to 50 microns.

| Ingredients (weight %) | Ex. 1 | Ex. 2 | Ex. 3 | Ex. 4 | Ex. 5 | Ex. 6 |
|---|---|---|---|---|---|---|
| guanidine nitrate | 43 | 40.5 | 33 | | | 47 |
| nitroguanidine | | | | 47.75 | | |
| triaminoguanidine nitrate | | | | | 39 | |
| potassium nitrate | 52 | 52 | 57 | 47 | 56 | 47 |
| dipotassium dodecahydrododecaborate | 5 | 2 | 4.5 | 2 | 5 | 3 |
| tetranitrocarbozole | | 5 | 5 | 3 | | |
| magnesium stearate | | 0.5 | 0.5 | 0.25 | | 0.5 |
| guar gum | | | | | | 2.5 |

The composition in each example was prepared by thoroughly mixing, via high speed agitation, the solid ingredients using heptane as a liquid non-solvent mixing media a to form a thoroughly mixed slurry. The slurry was agitated for one hour and a solid mixture of the ingredients was separated from the heptane by filtering.

The resultant solid mixture was trayed, granulated, oven dried, and subjected to standard effluent testing, such as set forth in the SAE Recommended Practice J1794 for RESTRAINT SYSTEMS EFFLUENT TEST PROCEDURE dated Mar. 16, 1995. The results of the testing are provided below.

| Example No. | Heat of Explosion, (cal/gm) | 5 second Autoignition Temperature, (° C.) | Flame Temperature, (° F.) | Gas Yield, (moles/100 gm) |
|---|---|---|---|---|
| 1 | 980 | 368 | 1691 | 2.706 |
| 2 | 912 | 328 | 1697 | 2.588 |
| 3 | 964 | 396 | 1810 | 2.532 |
| 4 | 1177 | 354 | 2287 | 2.849 |
| 5 | 1264 | 344 | 1901 | 2.887 |
| 6 | 828 | 368 | 2158 | 2.831 |

As can be seen, the compositions of the present invention provide for high gas generation rates per 100 gram of generant compared to the typical rate of approximately 1.8 moles/gram. The increase may be attributed to the increased fuel percentages that can be used with the compositions of the present invention. One skilled in the art will appreciate that lower percentages of the fuel source can be employed to produce varying gas generation rates and thermal conditions.

The compositions demonstrate a unique characteristic in the substantial variability and control of the gas generant burn rate is achievable through a simple stoichiometric manipulation of the fuel source in relation to the corresponding percentage of burn rate modifier. The percentage of the burn rate modifier in the gas generant compositions appears to have the greatest influence on the subsequent burn rate.

In addition, the compositions exhibit good thermal stability. The compositions do not react when subjected to temperatures of 107° C. for periods of up to 480 hours.

When compositions of the present invention are combusted, the gaseous effluents produced during combustion are particularly useful in the operation of micro-gas generators used to actuate seat belt pretensioners, such as shown in FIG. 1, and the operation of other pyrotechnic based automotive safety restraint devices ("air-bags"), and other applications requiring rapid inflation of a device, such as safety buoying devices, life rafts and aircraft slides.

When employed in the aforementioned devices, initiating and pickup charges are generally used in conjunction with the gas generant compositions, which acts as an output charge. The initiating and pickup charges are provided to respectively initiate and accelerate upon initiation the combustion reaction of the output charge. Typical initiating charges include compositions such as zirconium metal powder, potassium perchlorate, Viton-B$^{TM}$ (copolymer of vinylidene fluoride and hexfluoropropylene) and graphite. Pickup charges commonly include boron and potassium nitrate compositions along with a binder, such as Laminac 4116.

The seat belt pretensioner actuation device 10 includes a chamber 12 containing the output charge 14 along with the initiating charge 16 and pickup charge 18. Electrical leads 20 from an electrical ignition source 22 are placed in contact with the initiating and pickup charges, 16 and 18. An actuating platen 24 is provided within the chamber 12 to transmit work generated by the production of gas during the combustion reaction to a seat belt pretensioner assembly 26, which can be configured to lock the seat belt in place and/or take up slack in the belt to more fully restrain a passenger wearing the seat belt.

Those of ordinary skill in the art will appreciate that a number of modifications and variations that can be made to specific aspects of the method and apparatus of the present invention without departing from the scope of the present invention. Such modifications and variations are intended to be covered by the foregoing specification and the following claims.

What is claimed is:

1. A gas generating composition comprising:

a fuel source comprising a compound having a fuel portion and a fuel oxidizing portion;

a fuel oxidizer; and, a dodecahydrododecoborate salt catalyst of the oxidation of said fuel portion by said fuel oxidizing portion and said fuel oxidizer to produce gaseous reaction products.

2. The gas generating composition of claim 1 wherein: said fuel source comprises a fuel portion selected from the group consisting of guanidines and derivatives and combinations thereof and said oxidizing portion is comprised of the elements nitrogen and oxygen; and said oxidizer comprises a metal nitrate.

3. The gas generating composition of claim 1 wherein:

said fuel source is selected from the group consisting of guanidine nitrate, nitroguanidine, triaminoguanidine nitrate, and combinations thereof; and said oxidizer comprises potassium nitrate.

4. The gas generating composition of claim 3 wherein:

said fuel source comprises 10–50% by weight of said composition;

said oxidizer comprises 45–90% by weight of said composition; and, said dodecahydrododecaborate salt comprises 0–5% by weight of said composition.

5. The gas generating composition of claim 1 wherein said oxidizer and said oxidizing portion are provided in an effective amount to oxidize said fuel portion.

6. The gas generating composition of claim 1 wherein said compound comprises a cationic fuel portion and an anionic fuel oxidizing portion.

7. The gas generating composition of claim 6 wherein said cationic fuel portion comprises guanidinium, and derivatives and combinations thereof.

8. The gas generating composition of claim 6 wherein said anionic fuel oxidizing portion comprises nitrate.

9. The gas generating composition of claim 6 wherein:

said cationic fuel portion is selected from the group consisting of guanidinium, triaminoguanidine, and combinations thereof; and, said anionic fuel oxidizing portion comprises nitrate.

10. The gas generating composition of claim 1 wherein said compound comprises a fuel portion having a fuel oxidizing functional group.

11. The gas generating composition of claim 10 wherein said fuel portion comprises nitroguanidine, and derivatives and combinations thereof.

12. The gas generating composition of claim 1 wherein:

said fuel portion consists of at least one of the elements carbon, nitrogen, or hydrogen; and, said oxidizing portion consists of at least one of the elements carbon, nitrogen, or hydrogen, and oxygen.

13. The gas generating composition of claim 1 wherein said fuel source includes a fuel compound that does not include an oxidizing portion, said fuel compound being present in a minor portion relative to said compound containing said oxidizing portion.

14. A gas generating composition comprising:

an initiating charge;

a pickup charge; and, an output charge consisting essentially of:

a fuel source comprising a compound having a fuel portion and a fuel oxidizing portion;

a fuel oxidizer; and, a dodecahydrododecaborate salt catalyst of the oxidation of said fuel portion by said fuel oxidizing portion and said fuel oxidizer to produce gaseous reaction products.

15. The gas generating composition of claim 14 wherein said initiating charge comprises zirconium powder and potassium perchlorate in an effective amount to initiate a oxidation of said composition.

16. The gas generating composition of claim 14 wherein said pickup charge comprises boron and potassium nitrate in an effective amount to enhance oxidation of said initiating charge and ignite said output charge.

17. A method of producing a gas generant composition comprising:

providing ingredients for a gas generant composition consisting essentially of a fuel source comprising a compound having a fuel portion and a fuel oxidizing portion, a fuel oxidizer, and a dodecahydrododecaborate salt catalyst for the oxidation of said fuel portion by said fuel oxidizing portion and said fuel oxidizer to produce gaseous reaction products; and, mixing the ingredients to produce the gas generant composition.

18. A method of inflating an inflatable device comprising:

providing in an inflatable device an effective amount of a gas generant composition to inflate the device upon ignition of the composition which consists essentially of a fuel source comprising a compound having a fuel portion and a fuel oxidizing portion, a fuel oxidizer, and a dodecahydrododecaborate salt catalyst of the oxidation of said fuel portion by said fuel oxidizing portion and said fuel oxidizer to produce gaseous reaction products; and igniting the composition.

19. The method of claim 18 wherein said inflatable device is selected from the group consisting of: seat pretensioners, airbags, life saving buoying devices, life rafts, and aircraft slides.

* * * * *